US006651282B1

(12) United States Patent
Skoug et al.

(10) Patent No.: US 6,651,282 B1
(45) Date of Patent: Nov. 25, 2003

(54) NURSING PILLOW FOR ANATOMICALLY CORRECT POSITIONING OF BABY AND MOTHER

(76) Inventors: Stein Erik Skoug, 28 Charron Ave., Ste 3, Nashua, NH (US) 03063; Gurli Skattum, Hunshovde 8, Giovik (NO), 2800; Kenneth Edward Igoe, 35 Lawson Farm Rd., Londonderry, NH (US) 03053

( * ) Notice: Subject to any disclaimer, the term of this patent is extended or adjusted under 35 U.S.C. 154(b) by 0 days.

(21) Appl. No.: 09/487,448

(22) Filed: Jan. 19, 2000

(51) Int. Cl.[7] ..... A47G 9/00
(52) U.S. Cl. ..... 5/655; 5/644; 5/911; 5/655.4
(58) Field of Search ..... 5/655, 646, 911, 5/655.4, 655.3, 636, 644

(56) References Cited

U.S. PATENT DOCUMENTS 4,689,844 A * 9/1987 Alivizatos ..... 5/655
5,109,557 A * 5/1992 Koy et al. ..... 5/655
5,154,649 A * 10/1992 Pender ..... 5/652
5,661,861 A * 9/1997 Matthews ..... 248/918
6,161,239 A * 12/2000 Grazel ..... 5/655
6,230,349 B1 * 5/2001 Silver et al. ..... 297/393
6,233,767 B1 * 5/2001 Horowitz ..... 5/490

* cited by examiner

*Primary Examiner*—Heather Shackelford
*Assistant Examiner*—Fredrick Conley
(74) *Attorney, Agent, or Firm*—Davis & Bujold, P.L.L.C.

(57) ABSTRACT

A flexible, crescent shaped pillow to assist mothers to maintain an anatomically correct alignment between mouth and nipple while breast feeding. This alignment is a key factor in ensuring optimum flow of milk. The pillow is both highly flexible and supportive. These are the key features that make it an effective aide to breast feeding mothers. These properties are achieved through the use of a low density bead filling which can shift and flow within the casing, thus providing the correct support where it is needed. The pillow is designed to be used while feeding in a variety of positions and from either breast. Use of the pillow also reduces fatigue and stress for both baby and mother while nursing. The bead filling allows for the passage of air and liquids through the pillow. This contributes to increased safety in terms of reduced risk of suffocation. and less opportunity for the growth of mold and bacteria.

1 Claim, 2 Drawing Sheets

NURSING PILLOW FOR ANATOMICALLY CORRECT POSITIONING OF BABY AND MOTHER

CROSS-REFERENCE TO RELATED APPLICATIONS

Not Applicable

STATEMENT REGARDING FEDERALLY SPONSORED R & D

Not Applicable

REFERENCE TO A MICROFICHE APPENDIX

Not Applicable

BACKGROUND OF INVENTION

This invention is a pillow specifically designed to permit the easy adjustment of its filling to support the baby in a variety of nursing positions in anatomically correct mouth-nipple alignment for feeding at either breast through the entire nursing session. With the baby thus positioned and supported, the mother can also maintain an ergonomically correct position for herself. Nursing becomes a relaxed healthy experience for both baby and mother.

The invention addresses two key factors that contribute to breast feeding problems.

1. Alignment. Alignment of the baby's mouth and mother's nipple is key to ensure proper breast feeding. If the alignment is incorrect, the baby may receive an inadequate supply of milk, or in the worst case, actually expend more calories in getting the milk than are contained in the milk received. This condition, know as "Insufficient Milk Syndrome", may jeopardize the health and development of the baby.

2. Fatigue. Once correct position is achieved, the mother can experience difficulty in maintaining it throughout the feeding due to factors such as fatigue, back ache and stress on arms and shoulders. Mothers often use support devices such as conventional pillows to reduce this fatigue.

The invention is designed for increased safety and cleanliness. The filling allows the passage of air and liquids. This reduces the risk of suffocation along with the opportunity for the growth of mold and bacteria.

Previous designs for pillows to assist mothers while nursing have addressed issues regarding the comfort of the mother. They are designed to reduce backache, neck, shoulder, arm and/or other stresses experienced by nursing mothers. These devises can be beneficial to the mother. They do not address the critical issue of anatomically correct mouth-nipple alignment for proper transfer of nutrition. In fact they often contribute to the problem, thus affecting the welfare of the baby. This is why many lactation specialists do not recommend their use.

We have found several products on the market and several patents for products in this field. None are directed toward solving the problem of mouth-nipple alignment, nor does their structure allow them to be effective in this regard. The three closet inventions are listed below.

U.S. Pat. No. 5,109,557, issued to Kay, Johnson and Mumaugh, is a pillow designed to assist nursing mothers. However, the pillow is of uniform firmness and does not allow for adjustment to the shape of the baby and or mother. This hampers establishment of correct nursing position. The applicants' pillow utilizes a lose filling of beads that can be shifted within the pillow to facilitate easy adjustment to the shape of baby and mother for an anatomically correct nursing position. The filling of Kay's pillow is "a foam substance or compressed and fused fibers" or "any sturdy, firm washable substance." No reference is made to breath ability. Applicants' pillow uses filling that allows for the passage of air and liquids around the beads and through the pillow. This key feature reduces the danger of suffocation while limiting the opportunity for the growth of mold and bacteria.

U.S. Pat. No. 4,731,890, issued to Roberts, is a pillow adapted for nursing mothers. However, the pillow is "L" shaped and designed to support the mothers back and extending to the arm. This limits the positioning and support of the baby. The filling is polyester fiber which allows for some compression, but cannot shift withing the casing. The applicants' pillow is crescent shaped to support the entire length of the baby in various nursing positions. The filling of the applicants pillow is made of beads which shift within the case, allowing for total conformity to the shapes of the mother and baby for anatomically correct alignment in various feeding position. Roberts' pillow is not washable and makes no claims regarding breath ability. Applicant's pillow is completely washable. The applicant's pillow is designed to facilitate the flow of air and liquids through the pillow.

U.S. Pat. No. 5,261,134, issued to Mathews, is a pillow designed for infant support. It is for the purpose of supporting an infant in a sitting position. While it can be used as an aide in breast feeding, it is not specifically designed for this purpose and does not address the important issues of breast feeding. It's use in this application can cause difficulties for both mother and infant. The applicants pillow is specifically designed for breast feeding and the requirements thereof.

BRIEF SUMMARY OF THE INVENTION

The invention is made of a crescent shaped casing containing a lose filling of beads. The density of the bead filling is such that it is sufficient to support the nursing baby while still being able to shift within the casing to make the pillow flexible and adjustable. These two properties enable the mother to easily position and support her baby with anatomically correct nipple-mouth alignment in a variety of nursing positions at either breast and to help her by reducing fatigue. This helps ensure the free flow of milk and adequate nutrition to the baby. Thus supported and positioned, the mother can also maintain an ergonomically correct position for herself. Nursing becomes a healthy relaxed experience for both baby and mother.

The great flexibility of the invention makes it easily adjustable regardless of the size of the baby or mother.

BRIEF DESCRIPTION OF THE SEVERAL VIEWS OF THE DRAWING

Figure one show the profile of the crescent shape of the invention. The inside (concave) curve of the pillow is fitted against the mothers body. The pillow flexes to conform to the shape of the baby at the feeding position being used. The mother adjust the bead filling within the pillow to provide anatomically correct mouth-nipple alignment and support.

Figure two is a cross section of the pillow. The pillow is filled with beads to approximately 75% of available volume (plus or minus 20 liters). Key to the function of the pillow is that the filling can be shifted within the casing. Therefore, the heigh measurement of 3.5 inches is average. The shape shown is when not being used. As a function of the invention, the shape will change according the requirements of use.

Figure 1:
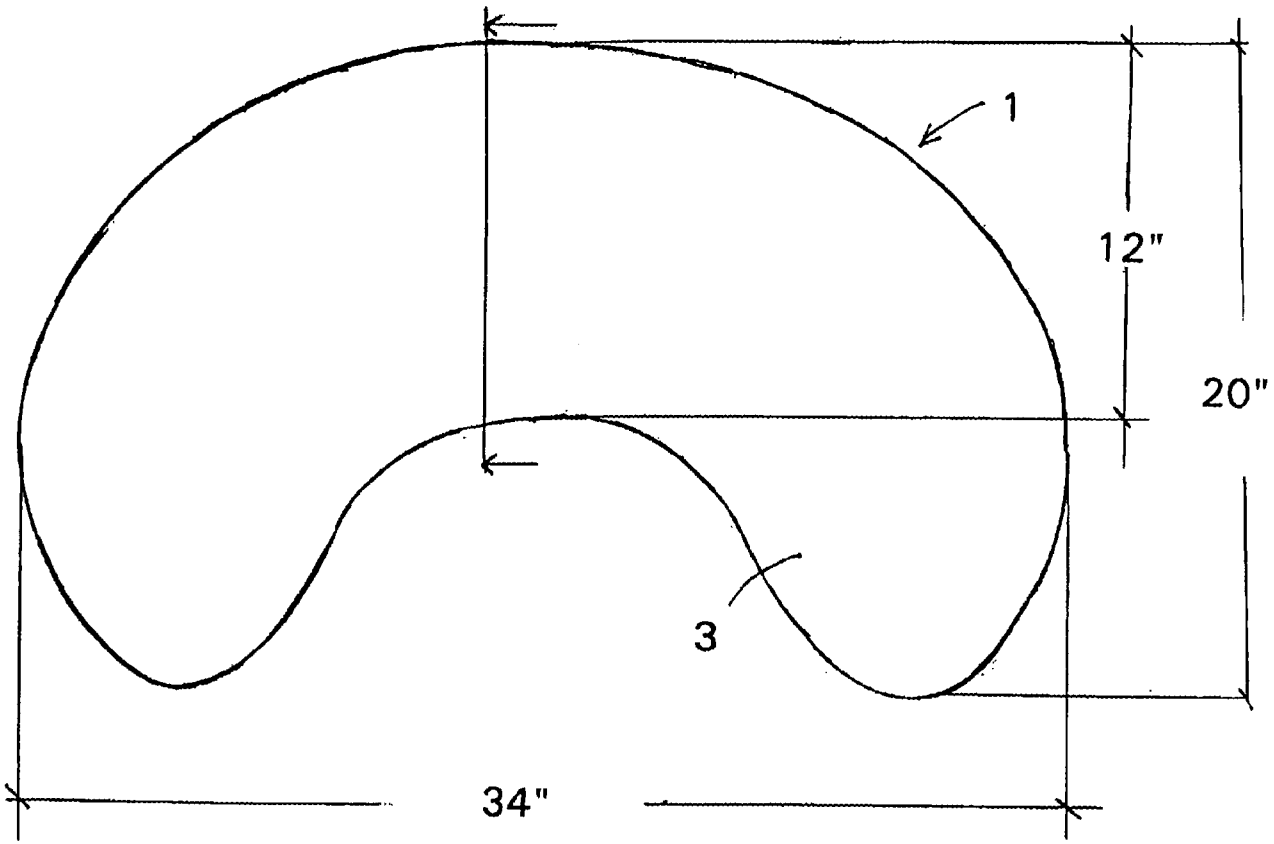
Figure 2:
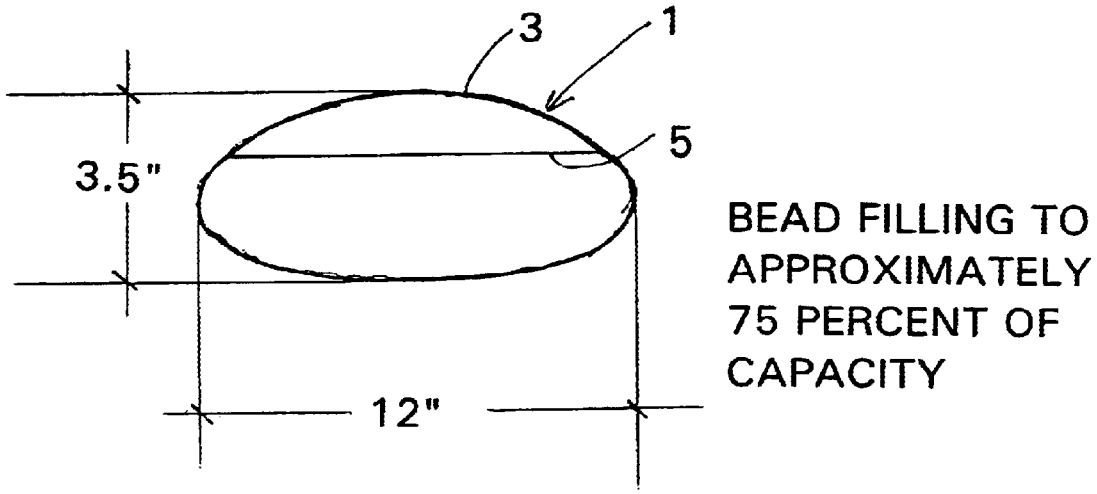

The dimensions specified in figures one and two are those being used in a current configuration. They can be varied and are not key to the function of the invention.

DETAILED DESCRIPTION OF THE INVENTION

The invention is made of a crescent shaped flexible casing of a material such as cotton cloth. This casing contains a filling of beads. The beads can be polystyrene or any material that can flow easily inside the casing. The casing is filled to approximately 75% of its total capacity, allowing the filling material to shift in response to pressure being applied from outside the pillow. This feature is key to the effective use of the pillow. It allows the pillow to conform to the shape of the baby and the mother while allowing the mother to adjust its support of the baby for correct mouth-nipple alignment. The flexibility of the pillow allows it to be effective in virtually any feeding position that may be required for the baby. This includes the cradling, "football" position and the head down position.

In the cradling position, the sitting mother places the pillow on her lap and the baby on the pillow at her breast. The mother adjusts the pillow's filling to support the baby at the proper elevation and angle for correct mouth-nipple alignment.

In the "football" position, the mother puts one end of the pillow under her arm with the pillow arcing forward and under the her breast. The baby is positioned on the pillow with its feet at the mother's shoulder or under her arm and its head at the mother's breast. The pillow is adjusted for correct mouth-nipple alignment.

The use is similar for other feeding positions.

The nature of the design also facilitates the flow of air through the pillow. This reduces the risk of suffocation and retards the growth of mold and bacteria. With the preferred use of gas permeable polystyrene beads as the filling material, these features are greatly enhanced.

What is claimed is:

1. A nursing pillow for facilitating proper anatomical support and alignment between a mother and a baby during a breast feeding session, the nursing pillow comprising:

an outer surface delineating an elliptical cross section defining an arcuate crescent shaped volume having a contiguous incurvate body encompassing edge and an outer edge, the curved outer edge having a substantially larger radius of curvature than the incurvate body encompassing edge and the contiguous incurvate body encompassing edge and outer edge are concentrically arranged and symmetrical on either side of a common midpoint defining a first and second pillow portions of equal dimension on either side of the midpoint;

a flowable filling comprising a plurality of gas permeable beads filling approximately 75% of the arcuate crescent shaped volume delineated by the outer surface of the nursing pillow, the flowable filling allowing the pillow to conform to the shape of the baby and the mother and adjustably support the baby for correct mouth-nipple alignment between the baby and mother in various feeding positions;

the curved inner edge of the nursing pillow defining a body encompassing portion for substantially encircling a mid-section of the nursing mother's body; and wherein during the breast feeding session the nursing pillow encompasses the mid-section of the mother's body and the baby is directly supported on the outer surface of the nursing pillow and the filling is adjusted to support the baby at an appropriate elevation and angle in proper alignment with the mother to facilitate proper breast feeding technique.

* * * * *